US005536294A

United States Patent [19]

Gill et al.

[11] Patent Number: 5,536,294

[45] Date of Patent: Jul. 16, 1996

[54] PROCESS FOR EXTRACTING PRECIOUS METALS FROM VOLCANIC ORE

[76] Inventors: Wayne L. Gill, 2343 E. Loma Vista Dr., Tempe, Ariz. 85282; Glenn W. Travis, 7019 N. Via de la Siesta, Scottsdale, Ariz. 85258

[21] Appl. No.: 494,233

[22] Filed: Jun. 23, 1995

[51] Int. Cl.[6] ..... B22F 9/04

[52] U.S. Cl. ..... 75/359; 75/369; 75/421; 75/423; 75/428

[58] Field of Search ..... 75/359, 369, 421, 75/422, 423, 426, 427, 428

[56] References Cited

U.S. PATENT DOCUMENTS 3,150,960 9/1964 Hunter ..... 75/426

5,185,030 2/1993 Miller et al. ..... 75/369

5,439,503 8/1995 Burr ..... 75/421

OTHER PUBLICATIONS

Rosenbaum, D. B., "Preparation of High Purity Rhenium", *Journal of the Electrochemical Society*, vol. 103, No. 9, Sep. 1956, pp. 518–521.

*Primary Examiner*—George Wyszomierski

*Attorney, Agent, or Firm*—Tod R. Nissle

[57] ABSTRACT

A process for extracting precious metal from volcanic ore includes the steps of crushing the ore, heating the ore in a hydrogen atmosphere to soften oxide mineral encapsulating the precious metal, cooling the ore, grinding the ore, and processing the ore to extract precious metal.

1 Claim, 1 Drawing Sheet

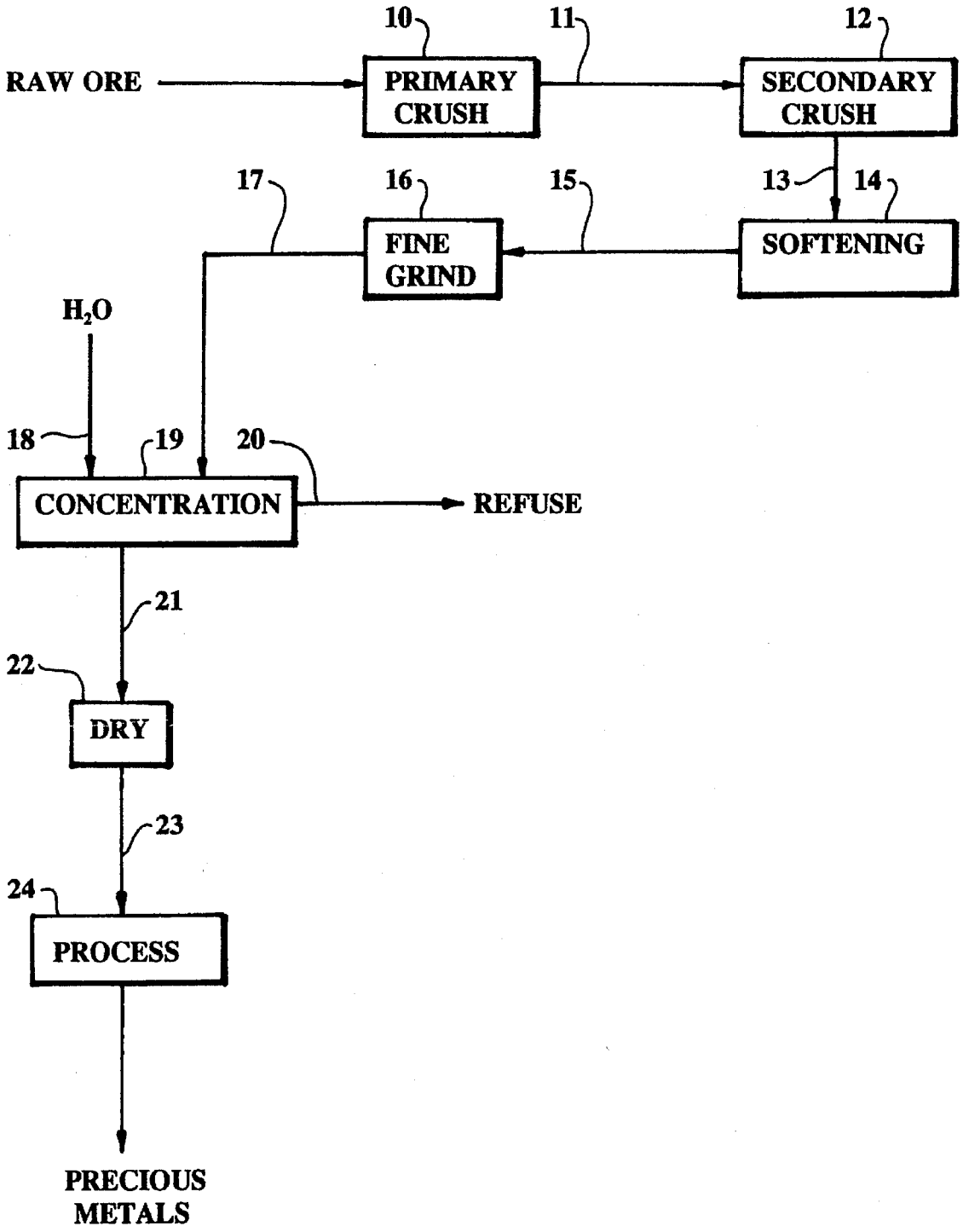
10
11
12
RAW ORE
PRIMARY CRUSH
SECONDARY CRUSH
17
16
15
13
14
FINE GRIND
SOFTENING
$H_2O$
18
19
20
CONCENTRATION
REFUSE
21
22
DRY
23
24
PROCESS
PRECIOUS METALS

PROCESS FOR EXTRACTING PRECIOUS METALS FROM VOLCANIC ORE

SUMMARY OF THE INVENTION

This invention relates to a process for extracting precious metals from volcanic ore.

More particularly, the invention relates to a process for extracting micron sized encapsulated gold from volcanic ore.

Although volcanic ores ordinarily contain precious metals, detecting such metals by assay is often difficult, as is the extraction of the precious metals from the ores. Extracting precious metals like gold from volcanic ore is thought to be difficult because the particles of gold and other precious metals in volcanic ore are often micron sized and are encapsulated by metal oxides. However, many volcanic ores have concentrations of precious metals which would, if recovered, have significant commercial value.

In accordance with the invention, I have now discovered a process for extracting precious metals from volcanic ore containing precious metals encapsulated by oxide minerals. The process includes the steps of, when necessary, crushing the ore; heating the ore in a hydrogen atmosphere to reduce and soften the oxide mineral encapsulating the precious metals in the crushed ore and to produce a hydrogen reactant ore product; cooling the hydrogen reactant ore product in a hydrogen atmosphere; grinding the cooled hydrogen reactant ore product; processing the cooled hydrogen reactant ore product to separate precious metal particles from the reactant ore product to produce a precious metal dore. The precious metal dore can be processed to extract the individual precious metals therefrom.

BRIEF DESCRIPTION OF THE DRAWING

The drawing depicts a presently preferred embodiment of the process for removing micron gold, free gold, and other precious metals from ore.

BRIEF DESCRIPTION OF THE INVENTION

Free gold is gold not encapsulated by an oxide mineral. Raw volcanic ore is subject to a primary crushing operation 10 to reduce the ore to pieces approximately one-half inch in size. Crushed ore 11 is subject to a secondary crushing operation 12 to reduce the ore to pieces approximately one sixteenth inch or smaller in size. The crushed ore 13 is hydrogen reduced and softened 14. During reduction and softening 14, the ore is transported on a conveyor or other transport system through an enclosed furnace having a hydrogen atmosphere. The hydrogen atmosphere is preferably 99%+ hydrogen. The furnace presently includes six (6) heated zones which permit the heating temperature of the ore to be gradually increased and then reduced as it passes through the furnace. Each heating zone is about two feet long. The ore passes sequentially through the first, second, third, etc. heating zones at a speed of about nine inches a minute. The number and length of the heating zones can be varied as desired, as can the speed of travel of the ore through the heating zones. The temperature of the first zone is 500 degrees C; of the second zone is 650 degrees C; of the third zone is 800 degrees C; of the fourth zone is 750 degrees C; of the fifth zone is 600 degrees C; and, of the sixth zone is 500 degrees C. While the minimum temperature in the furnace can be 500 degrees C or less, the best results have presently been obtained when the maximum temperature in each of the heating or cooling zones is in the range of about 800 to 900 degrees C (centigrade). The maximum temperature in the furnace is not sufficient to melt the ore. The ore travels through the furnace such that it is in each of the zones a sufficient period of time to heat the body of ore to about the temperature of the hydrogen atmosphere in the zone. After the ore has traveled through the furnace, it is cooled to 200 degrees C or less, preferably in a hydrogen atmosphere of other "neutral" i.e. nonoxidizing, gaseous atmosphere like nitrogen, etc. After being cooled to 200 degrees C or less in a hydrogen atmosphere, the ore is cooled in the ambient air to 100 degrees C or less. The cooled ore 15 is finely ground 16. A ceramic vibratory grinder or other desired grinder is utilized to finely grind the ore to form a 230 to 325 mesh powder having a uniform particle size to within plus or minus ten percent. During such grinding, it is critical that particles which have a size greater than ten percent of the desired size be separated from the ore. Accordingly, the ore is ground to a selected mesh which is less than 250. The finer 250 to 300 mesh grind is essential because it facilitates the liberation of heavier precious metals from the encapsulate mineral oxides in the ore. The powder 17 is mixed with water and a surfactant to form a slurry in the concentration step 19. During concentration step 19, the slurry is processed in a centrifugal concentrator to separate out the heavier precious metal particles or dore 21. The refuse or lighter weight particles 20 produced by the centrifugal concentrator are discarded. The dore 21 is dried 22 to produce a dore powder 23. The dore powder can be processed 24 to remove the individual precious metals therefrom. Flotation or various other conventional extractive metallurgy processes can be utilized to separate precious metals from the precious metal-rich powder 23. Such processes are well known and are not discussed herein.

EXAMPLE 1

A one pound sample of black volcanic cinder ore (i.e., raw or "head" ore) from the "Sheep Hill Black Hole" cinder cone near Flagstaff, Arizona was assayed for gold. The assay results are shown below in TABLE I:

TABLE I

| Assay of Volcanic Cinder Ore | |
|---|---|
| Component | Ounces per Ton in Head Ore |
| Au | 1.2 |

The cinders were each approximately one-quarter to three-eighths of an inch in size.

EXAMPLE 2

One thousand pounds (one-half ton) of the volcanic black cinder ore of Example 1 were processed as follows. Since the cinders were about three-eighths of an inch in size, the primary crush 10 step shown in the drawing was not necessary. The cinders were subjected to the secondary crush 12 to reduce the size of the particles to about one-eighth to one-sixteenth of an inch. The crushed ore 13 was processed through the six zone hydrogen atmosphere furnace described above. The furnace heated the ore to a maximum temperature of about 800 degrees centigrade. Passage of the ore through the six zone furnace required about sixteen minutes and the ore was in each zone for a little over two and a half minutes. For passage through the furnace, the ore was loaded in open metal containers which were each one and one-half inches deep, twelve inches long, and four inches wide. A conveyor belt carried the open metal containers through the furnace. After the heated cinder ore 15 was removed from the furnace it was cooled to about 200 degrees C in a hydrogen atmosphere and was then cooled to less than 100 degrees C by standing in ambient air. The cooled ore was ground 16 to form a powder 17 comprised of 230 to 325 mesh particles. The 230 to 325 mesh powder 17 was mixed with water and a surfactant to form a slurry. The slurry was directed into a centrifugal separator Model No. 400 manufactured by Mozley of England. The Mozley separator is distributed by Carpco, Inc. of Florida in the United States and, in addition to utilizing centrifugal force, a vibratory action and wipe system are employed to wipe particles off of a collection screen inside the separator. The precious metal dore 21 produced by the centrifugal concentrator was dried 22 and assayed for gold content. The assay is shown below in TABLE II. The weight of the dore was about 28.25 grams.

TABLE II

| Assay of Powder Dore Produced From Volcanic Cinder Ore | | |
|---|---|---|
| Component | Ounces per Ton Recovery | % Recovery of Gold from Head Ore |
| Au | 1.08 (15.3 grams of dore) | 90% |

EXAMPLE 3

A one pound sample of volcanic cinder ore (i.e., raw or "head" ore) from the Pritchard Claim about one hundred and forty mile north of Reno, Nev., the United States of America, was assayed for gold. The assay results are shown below in TABLE III:

TABLE III

| Assay of Compacted Volcanic Ash Ore | |
|---|---|
| Component | Ounces per Ton in Head Ore |
| Au | 2.19 |

EXAMPLE 4

Two hundred pounds of the volcanic ash ore of Example 3 were processed as follows. During the primary crush 10 step the ore was comminuted into particles each having a size of about one-half inch. The crushed ore 11 was subjected to the secondary crush 12 to reduce the size of the particles to about one-eighth to one-sixteenth of an inch. The crushed ore 13 was processed through the six zone hydrogen atmosphere furnace described above. The furnace heated the ore to a maximum temperature of about 800 degrees centigrade. Passage of the ore through the six zone furnace required about sixteen minutes and the ore was in each zone for a little over two and a half minutes. For passage through the furnace, the ore was loaded in open metal containers which were each one and one-half inches deep, twelve inches long, and four inches wide. A conveyor belt carried the open metal containers through the furnace. After the heated cinder ore 15 was removed from the furnace it was cooled to about 200 degrees C in a hydrogen atmosphere and was then cooled to less than 100 degrees C by standing in ambient air. The cooled ore was ground 16 to form a powder 17 comprised of 230 to 325 mesh particles. The 230 to 325 mesh powder 17 was mixed with water and a surfactant to form a slurry. The slurry was directed into a centrifugal separator Model No. 400 manufactured by Mozley of England. The Mozley separator is distributed by Carpco, Inc. of Florida in the United States and, in addition to utilizing centrifugal force, a vibratory action and wipe system are employed to wipe particles off of a collection screen inside the separator. The precious metal dore 21 produced by the centrifugal concentrator was dried 22 and assayed for gold content. The assay is shown below in TABLE IV. The weight of the dore was about 19.83 grams.

TABLE IV

| Assay of Powder Dore Produced From Volcanic Cinder Ore | | |
|---|---|---|
| Component | Ounces per Ton Recovery | % Recovery of Gold from Head Ore |
| Au | 2.08 (11.79 grams of dore) | 95% |

EXAMPLE 5

Example 2 is repeated, except that (1) the volcanic ore is ground to 300 mesh before the ore is passed through the six zone hydrogen furnace, and (2) the ore is not ground after passing through the furnace. Similar results are obtained.

EXAMPLE 6

Example 4 is repeated, except that (1) the volcanic ore is ground to 250 mesh before the ore is passed through the six zone hydrogen furnace, and (2) the ore is ground to 300 after passing through the furnace. Similar results are obtained.

EXAMPLE 7

Example 2 is repeated, except that after the ore is passed through the six zone hydrogen furnace, the ore is cooled from 500 degrees C to ambient temperature in a hydrogen atmosphere. Similar results are obtained.

EXAMPLE 8

Examples 1 and 2 are repeated, except that (1) in Example 1 the ore is assayed for and detects quantities of gold, silver, iridium, rhodium, ruthenium, and osmium, and (2) in Example 2 the dore is assayed for and detects quantities of gold, silver, iridium, rhodium, ruthenium, and osmium.

EXAMPLE 9

Examples 3 and 4 are repeated, except that (1) in Example 3 the ore is assayed for and detects quantities of gold, silver, iridium, rhodium, ruthenium, and osmium, and (2) in Example 4 the dore is assayed for and detects quantities of gold, silver, iridium, rhodium, ruthenium, and osmium.

Having described the presently preferred embodiments of my invention and having described my invention in such terms as to enable those skilled in the art to practice it,

I claim:

1. A process for extracting precious metals from volcanic ore containing micron sized gold particles encapsulated by oxide minerals, the process comprising the steps of (a) processing the ore to produce a preliminary ore mixture comprised substantially of particles less than or equal to about one sixteenth of an inch in size;

(b) heating the preliminary ore mixture in a hydrogen atmosphere to reduce and soften the oxide mineral encapsulating the gold in the processed ore and to produce a hydrogen reactant ore product;

(c) grinding the hydrogen reactant ore product to produce a powder substantially comprised of particles having a size equal to or less than about 200 mesh; and, (d) processing said powder to separate by specific gravity heavy precious metal particles from the reactant ore product to produce a precious metal dore.

* * * * *